US006936578B2

(12) United States Patent
Cordellina et al.

(10) Patent No.: US 6,936,578 B2
(45) Date of Patent: Aug. 30, 2005

(54) NONAQUEOUS LIQUID DETERGENT COMPOSITIONS

(75) Inventors: Antonio Cordellina, Abano Terme (IT); Giorgio Franzolin, Mirano (IT); Alessandro Latini, Bologna (IT); Sara Quaggia, Piove di Sacco (IT)

(73) Assignee: Reckitt Benckiser N.V., Hoofddorp NZ (NL)

( * ) Notice: Subject to any disclaimer, the term of this patent is extended or adjusted under 35 U.S.C. 154(b) by 157 days.

(21) Appl. No.: 10/466,051

(22) PCT Filed: Jan. 17, 2002

(86) PCT No.: PCT/GB02/00211

§ 371 (c)(1),
(2), (4) Date: Jul. 9, 2003

(87) PCT Pub. No.: WO02/057401

PCT Pub. Date: Jul. 25, 2002

(65) Prior Publication Data

US 2004/0072717 A1 Apr. 15, 2004

(30) Foreign Application Priority Data

Jan. 19, 2001 (EP) ..... 0101403

(51) Int. Cl.[7] ..... C11D 17/00

(52) U.S. Cl. ..... 510/296; 510/439; 510/481; 510/505; 510/491; 510/338

(58) Field of Search ..... 510/338, 295, 510/296, 439, 481, 491, 505

(56) References Cited

U.S. PATENT DOCUMENTS

| | | | | |
|---|---|---|---|---|
| 3,953,351 | A | 4/1976 | Keller | 252/132 |
| 4,310,433 | A | 1/1982 | Stiros | 252/132 |
| 4,717,507 | A | 1/1988 | Schwadtke et al. | 252/548 |
| 5,271,860 | A | 12/1993 | Schwadtke et al. | 252/96 |
| 5,604,192 | A | 2/1997 | Michael et al. | 510/180 |

FOREIGN PATENT DOCUMENTS

| | | | |
|---|---|---|---|
| EP | 0 042 648 | A1 | 12/1981 |
| EP | 0 080 749 | A1 | 6/1983 |
| EP | 0137 616 | A1 | 4/1985 |
| EP | 0 200 263 | A3 | 11/1986 |
| EP | 0 200 263 | A2 | 11/1986 |
| EP | 0 346 993 | A2 | 12/1989 |
| EP | 0 346 993 | A3 | 12/1989 |
| EP | 0 479 404 | A2 | 4/1992 |
| EP | 0 524 721 | A1 | 1/1993 |
| GB | 842813 | | 7/1960 |
| GB | 1 600 018 | | 10/1981 |
| GB | 2 234 981 | A | 2/1991 |
| GB | 2 244 258 | A | 11/1991 |
| WO | WO 92/17381 | | 10/1992 |
| WO | WO 00/23548 | | 4/2000 |
| WO | WO 00/55068 | | 9/2000 |

OTHER PUBLICATIONS

Patent Abstracts of Japan; Publication NO. 2000328099; Hori Taiji, "Neutral Liquid Detergent Composition"; Nov. 28, 2000.

*Primary Examiner*—Necholus Ogden
(74) *Attorney, Agent, or Firm*—Norris McLaughlin & Marcus PA

(57) ABSTRACT

A liquid detergent composition comprising:

a) a surfactant, and b) a fatty acid salt containing a fatty acid chain having at least one carbon—carbon double bond, wherein said composition, when dissolved in water to a concentration of 5 wt %, has a pH of 6.8 or less.

19 Claims, No Drawings

NONAQUEOUS LIQUID DETERGENT COMPOSITIONS

The present invention relates to liquid detergent compositions, especially compositions which contain a stabilised unsaturated fatty acid salt.

Liquid detergent compositions comprising surfactants are known. Such compositions can be used, for example, for laundry use, for example for fine-fabric laundry use or for heavy duty laundry use, or as hand or machine dishwashing compositions. They may also be used in liquid toilet rim blocks and as hard surface cleaners.

EP 0137616 discloses in Example X1 a water based microemulsion containing a coconut fatty acid, ethanolamine in which the pH is stated to be 6.6

U.S. Pat. No. 4,310,433 discloses in Example 1 a homogeneous water based mixture in which is present a mixture of lauric and oleic acid and potassium hydroxide.

Detergent compositions may contain fatty acid salts, in particular fatty acid salts containing a fatty acid chain having at least one carbon—carbon double bond. Such fatty acid salts can be used to control the amount of foam produced by the surfactants in the detergent compositions.

It has been found, however, that in such compositions the fatty acid salt may lack stability and cause the composition to discolour, for example to turn yellow, over time when the composition is stored. This is considered detrimental by consumers. It is postulated, although we are not bound by this theory, that the discolouration is caused by atmospheric oxidation of the carbon—carbon unsaturated bonds in the fatty acid chain.

We have surprisingly discovered that the discoloration can be controlled by ensuring that the liquid detergent composition has an appropriate pH.

Accordingly the present invention provides a liquid detergent composition comprising:

a) a surfactant, and b) a fatty acid salt containing a fatty chain having at least one carbon—carbon double bond, wherein said composition, when dissolved in water to a concentration of 5 wt %, has a pH of 6.8 or less.

The liquid detergent composition of the present invention has an acidic pH. It has been found that a composition having an acidic pH is more stable than liquid detergent compositions containing surfactants and fatty acid salts containing a fatty chain having at least 1 carbon—carbon double bond, which have an alkaline pH.

The pH of the composition is desirably 6.5 or less However, it is also desirably not too acidic, especially when the composition is used for laundry use. In such instances the pH is desirably at least 5, more desirably at least 5.5 and most desirably at least 6.0. However, compositions for other uses, such as toilet cleansers where an anti-limescale effect may be desirable, may have a lower pH, for example a pH of 5 or less, especially 4 or less.

The pH of the composition is measured when the composition has been dissolved in a large quantity of water. Thus the pH is measured when the composition is dissolved in water such that the final composition contains 5 wt % of the composition of the present invention and 95 wt % water. More accurate results are obtained by measuring the pH of the composition after it has been diluted because in some instances concentrated surfactants may interfere with pH measurement. Furthermore this enables the pH of an anhydrous composition to be measured.

The pH may be controlled by, for example, adding an acid or a base, or a buffer.

A preferred feature of the invention is that the water content of the liquid detergent composition is low. Preferably the water content is the total water content of the liquid detergent composition (which includes free water and water that is physically or chemically bound) is less than 50% wt, less than 10% wt, less than 30% wt, less than 20% wt, and, ideally, less than 10% wt. A preferred feature is where the total water content of the liquid detergent composition is less than 5% wt.

Suitable acids are, for example, organic acids such as acids containing from 1 to 6 carbon atoms and from 1 to 4, for example 2 or 3, acid groups such as carboxylic acid groups. Examples of such acids are citric acid and acetic acid. Other suitable acids are organic acids such as hydrochloric acid, sulfuric acid and boric acid.

Suitable bases are, for example, alkali metal, alkaline earth metal or ammonium hydroxides, carbonates or bicarbonates. Suitable alkali metals are sodium or potassium. Suitable alkaline earth metals are calcium and magnesium. Organic bases may also be used, such as amines substituted with from 1 to 4, such as 2 or 3, organic groups such as alkanol groups, for example methanol, ethanol, propanol or isopropanol groups. Desirably the amine is monoethanolamine, diethanolamine or triethanolamine or a mixture thereof. Particularly desirable is a mixture of monoethanolamine and triethanolamine, for example in a weight ratio of from 1:1 to 1:2, particularly 1:1.25 to 1:1.75, such as about 1:1.5, which may also lead to enhanced generation of foam.

The surfactant present in the composition is at least one surfactant chosen from anionic, nonionic, amphoteric, cationic and zwitterionic surfactants and mixtures thereof.

Anionic surfactants may include anionic organic surfactants, usually employed in soluble salt forms, preferably as alkali metal salts, especially as sodium salts. Although other types of anionic surfactants may be utilized, such as higher fatty acyl sarcosides, soaps of fatty acids (including metal soaps and amine soaps), preferred anionic surfactants are those which are described as of a sulfonate or sulfate type, which may be designated as sulf(on)ates. These include linear higher alkylaryl sulfonates (for example alkylbenzene sulfonates), higher fatty alcohol sulfates, higher fatty alcohol polyalkoxylate sulfates, olefin sulfonates, α-methyl ester sulfonates and paraffin sulfonates. An extensive listing of anionic detergents, including such sulf(on)ate surfactants, is given on pages 25 to 138 of the text Surface Active Agents and Detergents, Vol. II, by Schwartz, Perry and Berch, published in 1958 by Interscience Publishers, Inc. Usually the higher alkyl group of such anionic surfactants has 8 to 24 carbon atoms, especially 10 to 20 carbon atoms, preferably 12 to 18 carbon atoms, and the alkoxylate content of such anionic surfactants that are alkoxylated (preferably ethoxylated or ethoxylated/propoxylated) is in the range of 1 to 4 moles of alkoxy groups per mole of surfactant.

One class of anionic surfactants comprises alkali metal (preferably sodium) alkylaryl sulfonates (especially alkylbenzene sulfonates); preferably having linear $C_{9-14}$ alkyl groups.

Another preferred class of anionic surfactants comprises alkali metal (preferably sodium) alkyl sulfates, preferably having linear alkyl groups of 12 to 18 carbon atoms.

Another preferred class of anionic surfactants comprises alkali metal (preferably sodium) alkoxylated sulfates, preferably having linear alkyl groups of 12 to 18 carbon atoms, and preferably having 1 to 4 moles of alkoxy groups per mole of surfactant.

The anionic surfactant may be an alkyl benzene sulfonic acid neutralised with, for example, an alkanolamine. The alkanolamine may contain one, two or three alkanol groups, which may be same or different. For example it can contain one, two or three methanol, ethanol, propanol or isopropanol groups. Desirably it is a monoethanolamine, diethanolamine or triethanolamine or a mixture thereof. Particularly desirable is a mixture of monoethanolamine and triethanolamine; for example in a weight ratio of from 1:1 to 1:2, such as 1:1.25 to 1:1.75, for example about 1:1.5, which may lead to enhanced generation of foam.

It is known that alkyl benzene sulfonic acids can be produced by a variety of processes in which an alkyl chain is attached to a benzene ring by a catalysed reaction. Various catalysts are known. It is usual in liquid detergents to use an alkyl benzene sulfonic acid produced using an $AlCl_3$ catalyst. Such alkyl benzene sulfonic acids typically contain at least 25% of the2-phenyl isomer, that is the isomer in which the alkyl chain is attached to the benzene ring at the 2-position of the alkyl chain. These alkyl benzene sulfonic acids may be used in the present invention. The alkylbenzene sulfonic acid produced by a process using a hydrogen fluoride (HF) catalyst may also be used. This alkyl benzene sulfonic acid neutralised with an alkanol amine contains less than 20% of the 2-phenyl isomer, preferably less than 15% of the 2-phenyl isomer. Such alkyl benzene sulfonic acids are commercially available, for example as Solfodac AC 3-I from Condea or Petresul 550 from Petresa. These alkyl benzene sulfonic acids may provide compositions having better dissolution characteristics in large quantities of water than alkyl benzene sulphonic acids having a higher 2-phenyl isomer content.

Non-ionic surfactants may be selected from, for example, alcohol alkoxylates such as alcohol ethoxylates, also known as alkylpoly(ethylene oxides) and alkylpolyoxyethylene ethers, alkylphenol ethoxylates, ethylene oxide/propylene oxide block copolymers, alkyl polyglucosides, alkanolaamides and amine oxides. Alcohol ethoxylates, alkylphenol ethoxylates and ethylene oxide/propylene oxide block copolymers are condensation products of higher alcohols with lower alkylene oxides.

In such non-ionic surfactants the higher fatty moiety will normally be of 11 to 15 carbon atoms and there will usually be present from 3 to 20, preferably from 3 to 15, more preferably from 3 to 10, and most preferably from 3 to 7, moles of alkylene oxide per mole of higher fatty alcohol.

Non-ionic surfactants of interest include alkyl polyglucosides, the hydrophobic carbon chain length varying from 8 to 16 carbon atoms depending on the feedstock (oleochemical or petrochemical) and the hydrophilic polyglucose chain length varying between one and more than eight units of glucose.

Amphoteric surfactants may be selected from, for example, alkyl betaines, alkyl/aryl betaines, amidoalkyl betaines, imidazolinium-type betaines, sulfobetaines and sultaines.

The anionic surfactants are suitably present in a total amount of at least 10 wt %, and more preferably at least 20 wt %, based on the total weight of the composition. The anionic surfactants are also suitably present in an amount of up to 95 wt %, preferably up to 70 wt %, more preferably up to 60 wt %, based on the total weight of the composition.

One or more non-ionic surfactant(s), when present, is/are suitably present in an amount of at least 0.1 wt %, preferably at least 0.5 wt %, more preferably at least 1 wt %. Good compositions can also be prepared with higher amounts of non-ionic surfactant(s), for example in an amount of at least 2 wt %, preferably at least 4 wt%, and most preferably at least 8 wt %, on total weight of the composition. One or more non-ionic surfactant(s), when present, is/are suitably present in an amount of up to 80 wt %, preferably up to 70 wt %, more preferably up to 50 wt %, most preferably up to 35 wt %, and especially up to 20 wt %, based on the total weight of the composition.

One or more amphoteric surfactant(s), when present, is/are suitably present in an amount of at least 0.1 wt %, preferably at least 0.2 wt %, more preferably at least 0.4 wt %, based on the total weight of the composition. Good compositions can also be prepared with higher amounts of amphoteric surfactant(s), for example from 1 wt %, preferably from 2 wt %, more preferably from 5 wt %, based on the total weight of the composition. One or more amphoteric surfactant(s), when present, is/are suitably present in an amount up to 30 wt %, preferably up to 20%, more preferably up to 15 wt %, based on the total weight of the composition.

A preferred detergent composition, particularly a laundry detergent composition, includes as surfactant(s) one or more anionic surfactants and/or one or more non-ionic surfactants. Preferably such surfactant(s) is/are the only surfactant(s) or the major surfactant(s) present in the composition. By this we mean such surfactants in a larger amount by weight than all other surfactant types in total, and preferably constitute at least60 wt %, preferably at least 80 wt %, and more preferably at least 95 wt %, and most preferably 100 wt % of the total weight of. surfactants in the composition, excluding the fatty acid salt.

Especially preferred compositions employ alkyl benzene sulfonic acid neutralised with an alkanolamine as the surfactant, the fatty acid salt and no further surfactants. Alternative preferred compositions also employ one or more non-ionic surfactants, the weight ratio of the alkyl benzene sulfonic acid salt to the latter being at least 2:1, preferably at least 4:1.

In an alternative preferred embodiment the weight ratio so the alkyl benzene sulfonic acid salt to the non-ionic surfactant is at least 1:1, more preferably at least 0.75:1.

The surfactant, or surfactants in total, suitably provides at least 10 wt %, more preferably at least 20 wt %, most preferably at least 30 wt %, and especially at least 50 wt % of the total weight of a detergent composition such as a laundry detergent composition. Suitably the surfactant, or the surfactants in total, provide(s) up to 99 wt %, especially up to 95 wt %, for example up to 70 wt %, of the total weight of the composition.

The fatty acid salt contains a fatty chain having at least one carbon—carbon double bond. The fatty chain is generally a hydrocarbon chain. Desirably the fatty chain contains from 6 to 24 carbon atoms, preferably 8 to 24 carbon atoms, more preferably 10 to 22 carbon atoms, even more preferably 10 to 18 carbon atoms, and most preferably 12 to 16 carbon atoms. The fatty acid chain may contain only one carbon—carbon double bond, or may contain at least 2, for example, 2, 3 or more, carbon—carbon double bonds. The fatty acid chain may be linear or branched although linear is preferred. Examples of suitable fatty acids are coconut fatty acids and palm kernel fatty acids. The fatty acids which are used are generally mixtures of different fatty acids, some of which may contain only saturated fatty chains.

The fatty acid salt may be any salt which has an activity on the generation of foam by a surfactant. Desirably, however, it is in the form of alkali metal, alkaline earth metal, ammonium or amine salt. Examples of alkali earth metals are sodium, potassium and lithium. Examples of alkali earth metals are calcium and magnesium. Examples of amine salts are alkanol amine salts.

The alkanolamine in the fatty acid salt may contain one, two or three alkanol groups, which maybe same or different. For example it can contain one, two or three methanol, ethanol, propanol or isopropanol groups. Desirably it is a monoethanolamine, diethanolamine or triethanolamine or a mixture thereof. Particularly desirable is a mixture of monoethanolamine and triethanolamine, for example in a weight ratio of from 1:1 to 1:2, especially from 1:1.25 to 1:1.75, more especially about 1:1.5, which may lead to enhanced generation of foam. This alkanolamine may be the same or different than the alkanolamine which may be present in the anionic surfactant or the alkanolamine which maybe used to adjust the pH.

The fatty acid salt may be present in the composition in an amount of, for example, 20 wt %, for example to 10 wt %, preferably to 5 wt %, especially 2 to 3 wt %, especially about 2.5 wt %, based on the total weight of the compositon.

The detergent composition may also contain at least one solvent. The solvent may be water or an organic solvent, or a mixture thereof. The composition may be considered to be essentially anhydrous if it contains less than 5 wt. % water, desirably less than 2 wt % water and most desirably less than 1 wt % water. It will be appreciated that higher water content could be included in essentially anhydrous systems when it is chemically or physically bound.

The organic solvent may be any organic solvent, although it is desirable that it is miscible with water. Examples of organic solvents are glycols, glycerine or an alcohol. Preferred organic solvents are $C_{1-4}$ alcohols such as ethanol and propanol, and $C_{2-4}$ glycols such as monoethylene glycol and monopropylene glycol.

The organic solvent may be present in the composition in any amount, for example in an amount of up to 50 wt %. Preferably it is present in an amount of from 5 to 30 wt %, especially from 10.to 20 wt %, especially about 15 wt %.

A detergent composition of the present invention may include one or more further components such as desiccants, sequestrants, enzymes, silicones, emulsifying agents, viscosifiers, bleaches, bleach activators, hydrotropes, opacifiers, builders, foam controllers, solvents, preservatives, disinfectants, pearlising agents, limescale preventatives, such as citric acid, optical brighteners, dye transfer inhibitors, colour fading inhibitors, thickeners, gelling agents and aesthetic ingredients, for example fragrances and colorants.

The liquid detergent composition of the present invention may have a wide variety of uses. Thus it may be used, for example, as a laundry detergent composition, for example, for fine fabrics such as wool or for heavy duty laundry use such as for a normal wash. Alternatively the composition may be a wash booster for adding to the wash in addition to the usual detergent used. It may also be used as a hard-surface cleaner or in a liquid toilet rim block of the type described in EP-A-538,957 or EP-A-785,315. The composition may also be used as a hard-surface, cleaning composition or as a liquid hand or machine dishwashing composition.

The present composition is especially suitable for use in a water-soluble container where the container is simply added to a large quantity of water and dissolves, releasing its contents. The favourable dissolution and dispersion properties of the composition of the present invention are particularly useful in this context.

Thus the present invention also provides a water-soluble container containing a composition as defined above.

The water-soluble container may comprise a thermoformed or injection moulded water-soluble polymer. It may also simply comprise a water-soluble film. Such containers are described, for example, in EP-A-524,721, GB-A-2,244,258, WO 92/17,381 and WO 00/55,068.

In all cases, the polymer is formed into a container or receptacle such as a pouch which can receive the composition, which is filled with the composition and then sealed, for example by heat sealing along the top of the container in vertical form-fill-processes or by laying a further sheet of water-soluble polymer or moulded polymer on top of the container and sealing it to the body of the container, for example by heat sealing.

A preferred additional additive is an enzyme, especially a protease, or a mixture of enzymes (such as a protease combined with a lipase and/or a cellulase and/or an amylase, and/or a cutinase, and/or a peroxidase enzyme). Such enzymes are well known and are adequately described in the literature (see WO 00/23548 page 65 to 68, which is incorporated herein by reference).

The enzyme will be present in an amount of, by weight, 0.1 to 5.0%, ideally 0.3% to 4.0% and preferably 1% to 3%.

A preferred protease is an enzyme Genencor Properase, supplied by Genencor, address is Genencor International, Inc., 200 Meridian Centre Blvd. Rochester, N.Y. 14618-3916 USA.

Desirably the water-soluble polymer is a poly(vinyl alcohol) (PVOH). The PVOH may be partially or fully alcoholised or hydrolysed. For example, it may be from 40 to 100% preferably 70 to 92%, mote preferably about 88%, alcoholised or hydrolysed, polyvinyl acetate. When the polymer is in film form, the film may be cast, blown or extruded.

The water-soluble polymer is generally cold water (20° C.) soluble, but depending on its chemical nature, for example the degree of hydrolysis of the PVOH, may be insoluble in cold water at 20° C., and only become soluble in warm water or hot water having a temperature of, for example, 30° C., 40° C., 50° C. or even 60° C.

When the composition of the present invention is held in a water-soluble container, it desirably contains less than 5 wt % water, especially less than 3 wt %, 2 wt % or 1 wt % water. It may, however, contain more than 5 wt % water, although in this case precautions may have to be taken to ensure that the composition does not dissolve the water-soluble container before it is used, for example by ensuring that the composition contains a suitable amount of an electrolyte such as sodium chloride.

The containers of the present invention find particular use where a unit-dosage form of the composition is required. Thus, for example, the composition may be a dishwashing or laundry detergent composition especially for use in a domestic washing machine. The use of the container may place restrictions on its size. Thus, for example, a suitable size for a container to be used in a laundry or dishwashing machine is a rounded cuboid container having a length of 1 to 5 cm, especially 3.5 to 4.5 cm, a width of 1.5 to 3.5 cm, especially 2 to 3 cm, and a height of 1 to 2 cm, especially 1.25 to 1.75 cm. The container may hold, for example, from 10 to 40 g of the composition, especially from 15, 20 or 30 g to 40 g of the composition for laundry use or from 15 to 20 g of the composition for dishwashing use.

The viscosity of the composition of the present invention, measured using a Brookfield viscometer, model DV-II+, with spindle S31 at 12 RPM and at 20° C., is desirably 100 to 3000 cps, ideally 500 to 3000 cps, more especially 800 to 1500 cps, especially about 1100 cps.

Specific compositions described herein have a very low viscosity, despite having high surfactant contacts, and are a preferred feature of the invention having several advantages in handling and the filling of containers.

The present invention is now further described in the following Examples in which all the parts are parts by weight unless otherwise mentioned.

EXAMPLE 1

A Fine-Fabric Laundry Composition

The following components were mixed together:

| | |
|---|---|
| Monopropylene glycol | 15.0 parts |
| Genapol AO 3070 | 12.0 parts |
| Solfodac AC3-I | 45.0 parts |
| Monoethanolamine | 5.0 parts |

The composition was then subjected to continuous cooling, and the following components were added:

| | |
|---|---|
| Triethanolamine | 10.0 parts |
| Coconut fatty acid | 2.0 parts |
| Marlinat 242/90M | 9.0 parts |
| Bitrex (trade mark) | 0.005 parts |
| Dye (1% aqueous solution) | 0.13 parts |
| Perfume | 1.44 parts |

Genapol AO 3070 is a $C_{14-15}$ fatty alcohol ethoxylated with 3 or 7 ethylene oxide units in a 1:1 ratio.

Marlinat 242/90M is a $C_{10}$–$C_{14}$ alcohol polyethylene glycol (2EO) ether sulfate, monoisopropanolammmonium salt.

The composition was mixed until homogeneous. The pH, tested as indicated above, was found to be 6.8. A Multivac thermoforming machine operating at 6 cycles/min. and at ambient conditions of 25° C. under 35% RH(±5% RH) was used to thermoform a PVOH film. This was Monosol M8534 obtained Chris Craft Inc., Gary, Ind., USA, having a degree of hydrolysis of 88% and a thickness of 100 $\mu$m. The PVOH film was thermoformed into a rectangular mould of 39 mm length, 29 mm width and 16 mm depth, with its bottom edges being rounded to a radius of 10 mm at 115 to 118° C. The thus formed pocket was filled with 17 ml of the above composition, and a 75 $\mu$m thick film of Monosol M8534 PVOH was placed on top and heat sealed at 144 to 148° C.

The detergent composition was found to dissolve satisfactorily in domestic laundry machines. It was also found to dissolve quickly when added to a large quantity of water having a hardness of 25° F. at 20° C. to provide a final solution containing the detergent composition in an amount of 5 wt %.

EXAMPLES 2 TO 9

Example 1 was repeated, except for replacing the Genapol AO 3070 by the following components.

Example 2: Genapol UD 079 obtainable from Clariant, being a $C_{11}$ fatty alcohol ethoxylated with 7 ethylene oxide units. The pH of the composition was 6.19.

Example 3: Genapol UD O3O obtainable from Clariant, being a $C_{11}$ fatty alcohol ethoxylated with 3 ethylene oxide units. The pH of the composition was 6.08.

Example 4: Genapol OA O5O obtainable from Clariant, being a $C_{14-15}$ fatty alcohol ethoxylated with 5 ethyleneoxide units. The pH of the composition was 6.16.

Example 5: Lutensol TO3-TO7-1:1 obtainable from BASF, being a $C_{13}$ fatty alcohol ethoxylated with 3 or 7 ethylene oxide units in a 1:1 ratio. The pH of the composition was 6.12.

Example 6: Lutensol TO7 obtainable from BASF, being a $C_{13}$ fatty alcohol ethoxylated with 7 ethylene oxide units. The pH of the composition was 5.80.

Example 7: Lutensol TO5 obtainable from BASF, being a $C_{13}$ fatty alcohol ethoxylated with ethylene oxide units. The pH of the composition was 6.14.

Example 8: Lutensol AO7 obtainable from BASF, being a $C_{13-15}$ fatty alcohol ethoxylated with 7 ethylene oxide units. The pH of the composition was 5.96.

Example 9: Dehydol LT7 obtainable from Henkel, being a $C_{12-18}$ fatty alcohol ethoxylated with 7 ethylene oxide units. The pH of the composition was 6.29.

In all instances the composition was found to dissolve satisfactorily in a large amount of water following the test set out in Example 1.

EXAMPLE 10

The composition of Example 1 was evaluated for colour stability at different pHs. The pH of the composition was adjusted by varying the amount of triethanolamine In a first test, the pH of the composition of Example 1, measured as a 5% solution in water, was altered and the colour stability of the composition was monitored by after the composition had been kept under a xenon lamp to provide an artificial light exposure. The following results were obtained:

| pH | Discolouration noted |
|---|---|
| 8.23 | strong discolouration after 8 hours |
| 7.50 | strong discolouration after 16 hours |
| 6.81 | moderate discolouration after 24 hours |
| 5.92 | very small discolouration after 26 hours |

In a second test, the compositions were evaluated for colour stability at an elevated temperature of 40° C. under normal light conditions. The following results were obtained:

| pH | Discolouration noted |
|---|---|
| 8.23 | strong discolouration after 3 weeks |
| 7.50 | strong discolouration after 5 weeks |
| 6.81 | moderate discolouration after 5 weeks |
| 5.92 | small discolouration after 5 weeks |

What is claimed is:

1. A liquid detergent container comprising:

a) a surfactant, b) a fatty acid salt containing a fatty acid chain having at least one carbon—carbon double bond, and c) a total water content of less than 5 wt. %, wherein said composition, when dissolved an water to a concentration of 5 wt %, has a pH of 6.8 or less.

2. A container according to claim 1, wherein the water-soluble container comprises poly (vinyl alcohol).

3. A container according to claim 1 wherein the surfactant is an anionic or nonionic surfactant.

4. A container according to claim 2 wherein the fatty acid salt is an alkali metal, alkaline earth metal, ammonium or amine salt.

5. A container according to claim 3 wherein the fatty acid salt is an alkanolamine salt.

6. A container according to claim 5 wherein the alkanolamine is monoethanolamine, triethanolamine or a mixture thereof.

7. A container according to claim 1 wherein the fatty acid salt contains from 10 to 22 carbon atoms in the fatty chain.

8. A container according to claim 7 wherein the fatty acid salt contains from 12 to 16 carbon stains in the fatty chain.

9. A container according to claim 1 wherein the fatty acid salt contains a fatty chain containing at least two carbon—carbon unsaturated bonds.

10. A container according to claim 1 wherein the fatty acid salt contains a linear fatty chain.

11. A container according to claim 1 wherein the fatty acid salt is a coconut fatty acid salt.

12. A container according to claim 1 wherein the pH is 6.5 or less.

13. A container according to claim 1 wherein the pH is at least 5.5.

14. A container according to claim 1 which comprises the surfactant in an amount of from 10 to 80 wt % relative to the total amount of the composition.

15. A container according to claim 1 which comprises the fatty acid salt in an amount of from 1 to 20 wt %.

16. A container according to claim 1 wherein the pH has been adjusted by the addition of an alkali containing the same cation as that of the fatty acid salt.

17. A container according to claim 1 wherein the pH has been adjusted by the addition of an alkanolamine.

18. A container according to claim 1 which is a laundry detergent composition.

19. A container according to claim 18 which is a fine-fabric detergent composition.

* * * * *